US007461917B2

(12) United States Patent
Fogarty et al.

(10) Patent No.: US 7,461,917 B2
(45) Date of Patent: Dec. 9, 2008

(54) PRINTING A BAR IN A BAR CODE

(75) Inventors: Robert Fogarty, San Diego, CA (US); Kurt Thiessen, Escondido, CA (US); Ronald D. Stephens, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 366 days.

(21) Appl. No.: 11/007,931

(22) Filed: Dec. 9, 2004

(65) Prior Publication Data

US 2006/0125903 A1 Jun. 15, 2006

(51) Int. Cl.
*B41J 23/00* (2006.01)
*B41J 2/01* (2006.01)

(52) U.S. Cl. ..... 347/37; 347/107

(58) Field of Classification Search ..... 347/107, 347/103; 400/103; 358/1.2
See application file for complete search history.

(56) References Cited

U.S. PATENT DOCUMENTS 4,901,093 A * 2/1990 Ruggiero et al. ..... 347/70
5,890,818 A 4/1999 Sansone
6,533,378 B2 * 3/2003 Ishikawa ..... 347/10
2002/0167678 A1 * 11/2002 Shiraishi ..... 358/1.2

FOREIGN PATENT DOCUMENTS

JP 63230345 9/1988
JP 02279360 A * 11/1990
JP 2000203098 7/2000

OTHER PUBLICATIONS

International Search Report (PCT/US2005/039668), dated Apr. 5, 2006.

* cited by examiner

*Primary Examiner*—Matthew Luu
*Assistant Examiner*—Lisa M Solomon

(57) ABSTRACT

In one embodiment, a method for printing a bar in a bar code includes computing a print resolution for printing the bar using Bar Width, Dot Size and Number of Dots where Bar Width is a desired width of the bar, Dot Size is a nominal dimension of each dot measured in a direction across the width of the bar and Number of Dots is a number of dots to be printed across the width of the bar, and adjusting a spacing between dots based on the computed print resolution.

3 Claims, 8 Drawing Sheets

PRINTING A BAR IN A BAR CODE

BACKGROUND

Bar codes are formed by printing a series of parallel bars. Numbers, letters or other characters and information are represented by a predetermined number of bars and spaces between bars. The number of bars, the width of the bars, and the spacing between the bars are arranged to convey the desired information. The quality of a bar code is directly affected by the accuracy with which the bar code is printed. A bar code printed with significant dimensional inaccuracies may not convey the desired information when it is scanned.

DRAWINGS

DESCRIPTION

Embodiments of the present invention were developed in an effort to improve the accuracy with which a bar code is printed using an inkjet printer. Some embodiments of the invention, therefore, will be described with reference to inkjet printing. Embodiments of the invention, however, are not limited to use in inkjet printing. Rather, embodiments of the invention may be used in any application or environment which might benefit from these new bar code printing techniques. The exemplary embodiments shown in the figures and described below illustrate but do not limit the invention. Other forms, details, and embodiments may be made and implemented. Hence, the following description should not be construed to limit the scope of the invention, which is defined in the claims that follow the description.

Figure 1:
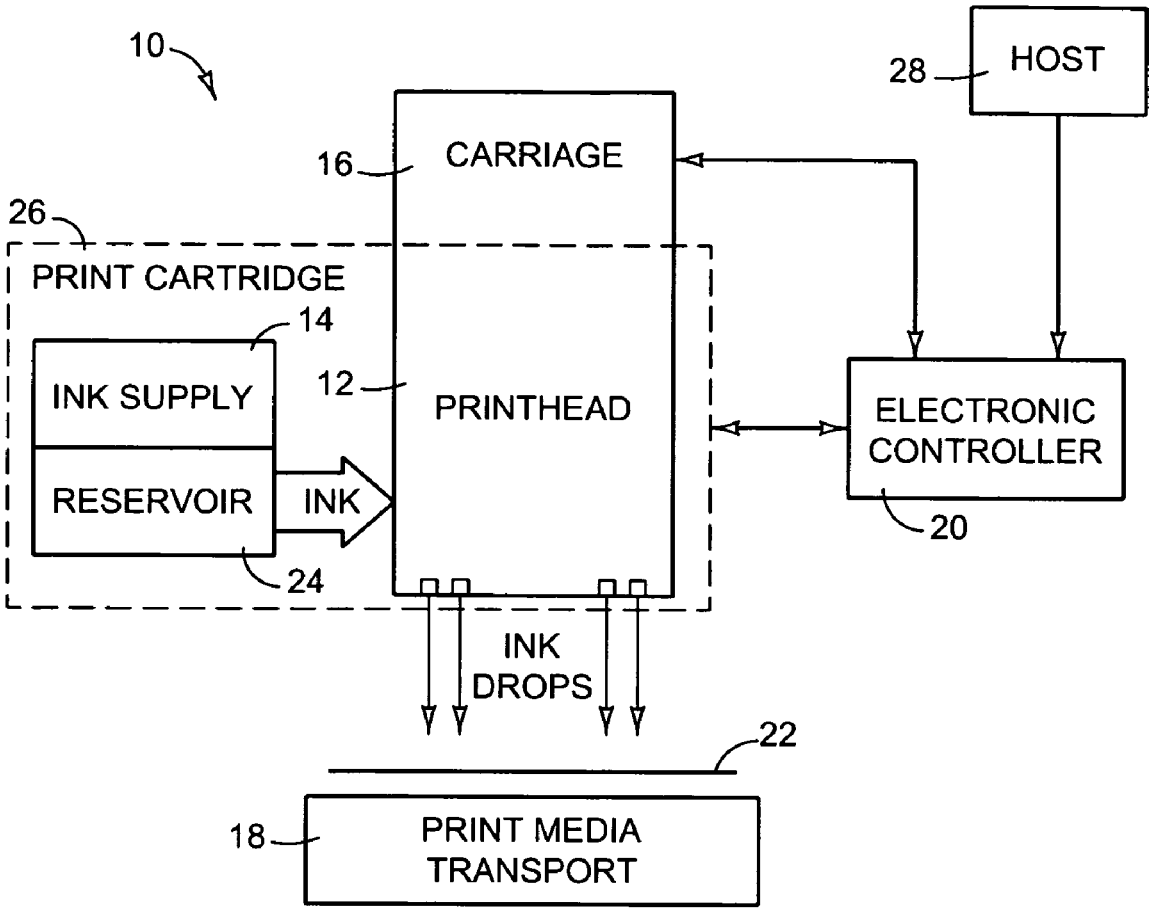
FIG. 1 is a block diagram illustrating an inkjet printer that may be used to implement embodiments of the invention.

FIG. 1 is a block diagram illustrating an inkjet printer that may be used to implement embodiments of the invention.

Referring to FIG. 1, inkjet printer 10 includes a printhead 12, an ink supply 14, a carriage 16, a print media transport mechanism 18 and an electronic printer controller 20. Printhead 12 represents generally one or more printheads and the associated mechanical and electrical components for ejecting drops of ink on to a sheet or strip of print media 22. A typical inkjet printhead includes an orifice plate arrayed with ink ejection orifices and firing resistors formed on an integrated circuit chip positioned behind the ink ejection orifices. The ink ejection orifices are usually arrayed in columns along the orifice plate. A flexible circuit carries electrical traces from external contact pads to the firing resistors. Each print head is electrically connected to printer controller 20 through the contact pads. In operation, printer controller 20 selectively energizes the firing resistors through the signal traces. When a firing resistor is energized, ink in a vaporization chamber next to a resistor is vaporized, ejecting a drop of ink through an orifice on to the print media 22. The vaporization chamber then refills with ink from an ink reservoir 24 connected to ink supply 14 in preparation for the next ejection.

Printhead 12 may include a series of stationary printheads that span the width of print media 22. Alternatively, printhead 12 may include a single printhead that scans back and forth on carriage 16 across the width of media 22. Other printhead configurations are possible. For example, if bar codes are printed on a comparatively narrow media strip 22, such as might be the case for printing bar code labels, then printhead 12 may include a single stationary printhead. Carriage 16 positions printhead 12 relative to media 22 and media transport 18 positions media 22 relative to printhead 12. For a scanning type printhead 12, carriage 16 is a movable carriage that includes a drive mechanism to carry printhead 12 back and forth across media 22. A movable carriage 16, for example, may include a holder for printhead 12, a guide along which the holder moves, a drive motor, and a belt and pulley system that moves the holder along the guide. Media transport 18 advances print media 22 lengthwise past printhead 12. For a stationary printhead 12, media transport 18 may advance media 22 continuously past printhead 12. For a scanning printhead 12, media transport 18 may advance media 22 incrementally past printhead 12, stopping as each swath is printed and then advancing media 22 for printing the next swath.

Ink supply 14 supplies ink to printhead 12 through ink reservoir 24. Ink supply 14, reservoir 24 and printhead 12 may be housed together in a single print cartridge 26, as indicated by the dashed line in FIG. 1. Alternatively, ink supply 14 may be housed separate from ink reservoir 24 and printhead 12, in which case ink is supplied to reservoir 24 and printhead 12 through a flexible tube or other suitable conduit. In other embodiments, ink may be supplied directly from ink supply 14 to printhead 12 without an intervening reservoir 24.

Controller 20 receives print data from a computer or other host device 28 and processes that data into printer control information and image data. Controller 20 controls the movement of carriage 16 and media transport 18. As noted above, controller 20 is electrically connected to printhead 12 to energize the firing resistors to eject ink drops on to media 22. By coordinating the relative position of printhead 12 and media 22 with the ejection of ink drops, controller 20 produces the desired image on media 22 according to the print data received from host device 28.

Figure 2:
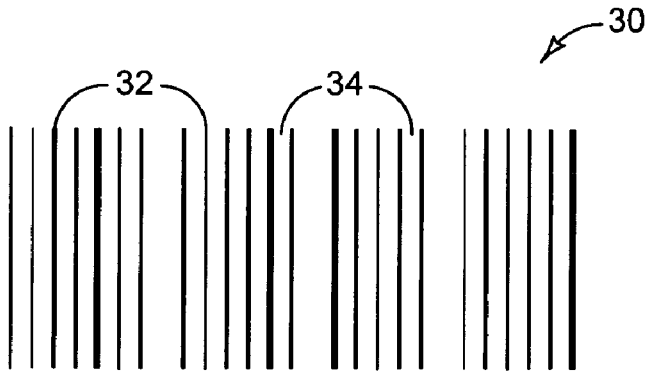
FIG. 2 illustrates a bar code made up of a series of bars separated by spaces.
Figure 3:
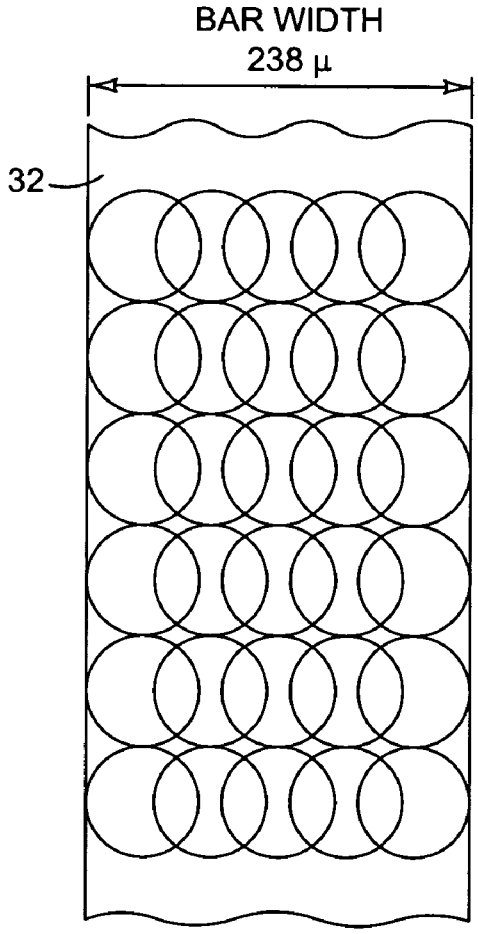
FIG. 3 illustrates a single bar from the bar code shown in FIG. 2 printed with five dots at a default print resolution.
Figure 5:
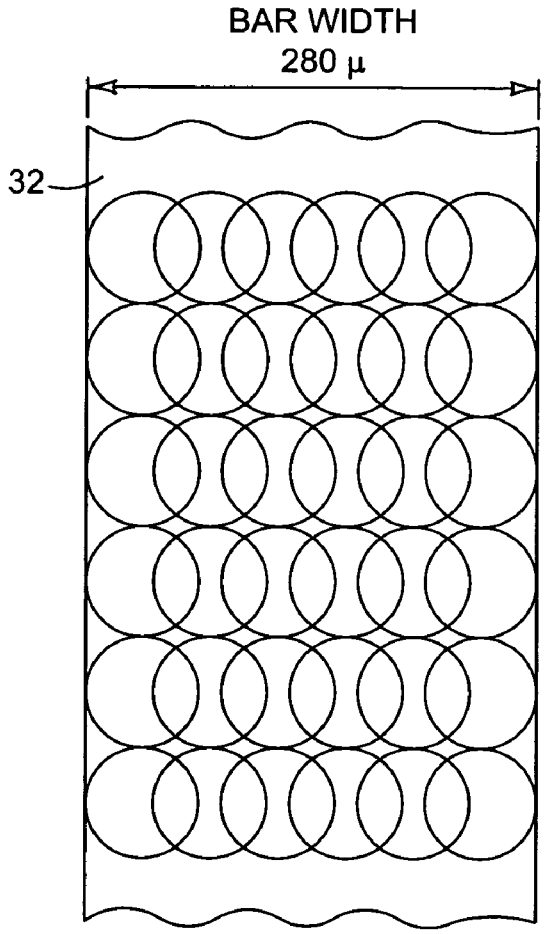
FIG. 5 illustrates a single bar from the bar code shown in FIG. 2 printed with six dots at a default print resolution.
Figure 9:
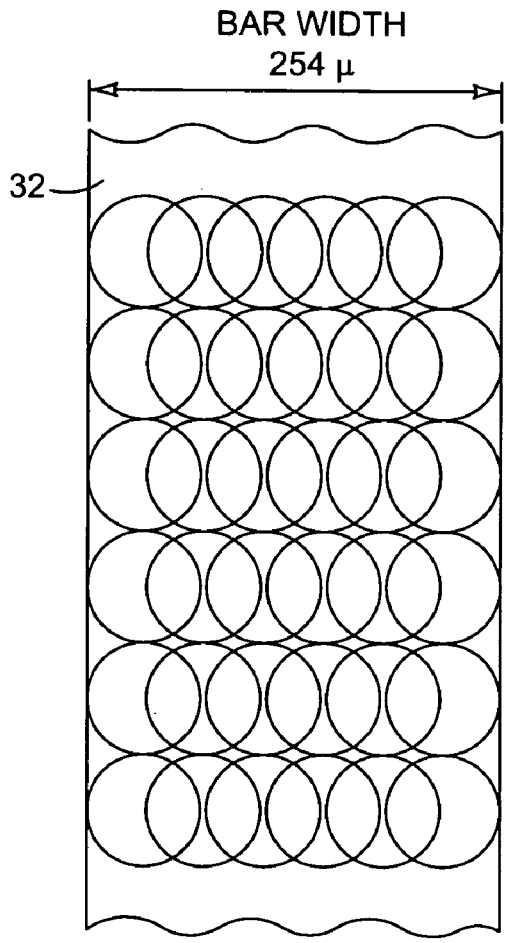
FIG. 9 illustrates a single bar from the bar code shown in FIG. 2 printed with six dots at an adjusted print resolution.

FIG. 2 illustrates a bar code 30 made up of a series of bars 32 separated by spaces 34. FIGS. 3 and 5 illustrate a single bar 32 from bar code 30 printed with five and six dots, respectively, at a default print resolution. FIGS. 7 and 9 illustrate a single bar 32 from bar code 30 printed with five and six dots, respectively, at adjusted print resolutions. FIGS. 4, 6, 8 and 10 are detail views of adjacent dots from the bar 32 of FIGS. 3, 5, 7 and 9, respectively. As used in this document, a "dot" means one of a series or array of individual imaging material marks a printer makes on print media. In inkjet printing, therefore, a dot refers to the mark formed when an ink drop is ejected on to the print media. As used in this document, "print resolution" means the nominal center to center spacing of dots measured in a direction across the width of a bar. In inkjet printing, print resolution is often designated by the number of ink dots per inch (dpi). For example, a print resolution of 600 dpi represents a nominal center to center dot spacing of 1/600 inch (42 microns). That is to say, the center of each ink dot in a bar is approximately 1/600 inch from the center of an adjacent ink dot measure in a direction across the width of the bar.

Figure 4:
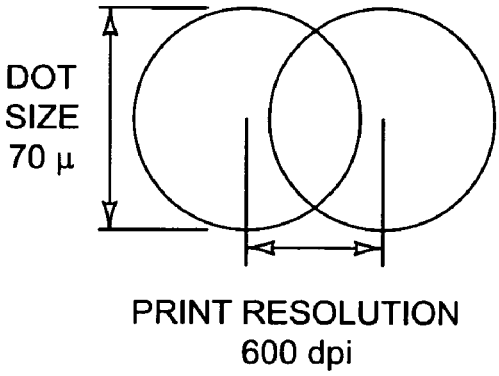
FIG. 4 is a detail view of adjacent ink dots from the bar shown in FIG. 3.

The relationship between the print resolution and the width of a bar 32 may be defined according to Equation no. 1:

$$\text{Bar Width}=\text{Dot Size}+((\text{Number of Dots}-1)\times\text{Print Resolution}) \quad \text{Eq. 1}$$

where Dot Size is the nominal diameter of each dot and Number of Dots is the number of dots to be printed across the width of the bar. For example, using a 70 micron diameter dot printed at a default Print Resolution of 600 dpi typical of many inkjet printers, a 10 mil (254 micron) bar 32 could be approximated by printing five dots or six dots across the width of bar 32. If five dots are printed, as shown in FIGS. 3 and 4, then the printed bar 32 is actually only 238 microns wide, computed according to Equation no. 1 as follows:

$$\text{Bar Width}=70\text{ microns}+((5-1\text{ dots})\times 600\text{ dpi})=238\text{ microns}$$

Figure 6:
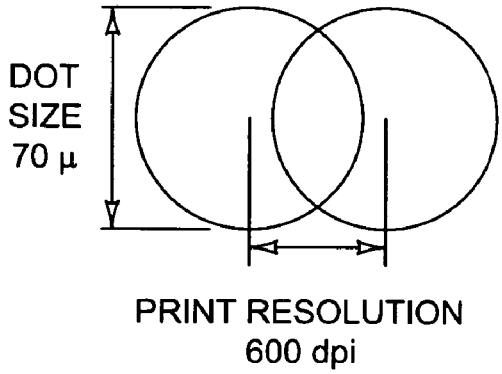
FIG. 6 is a detail view of adjacent ink dots from the bar shown in FIG. 5.
Figure 7:
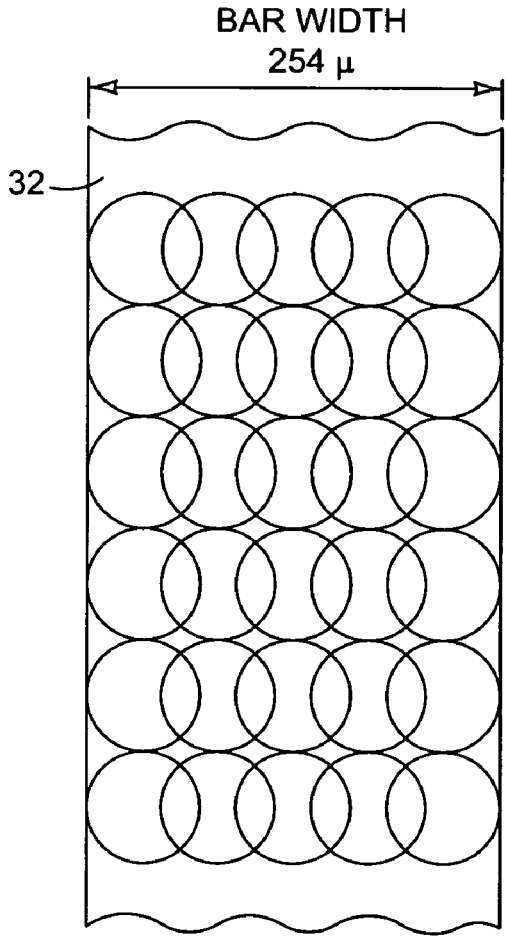
FIG. 7 illustrates a single bar from the bar code shown in FIG. 2 printed with five dots at an adjusted print resolution.

If six dots are printed, as shown in FIGS. 5 and 6, then the printed bar 32 is actually 280 microns wide, computed according to Equation no. 1 as follows:

$$\text{Bar Width}=70\text{ microns}+((6-1\text{ dots})\times 600\text{ dpi})=280\text{ microns}$$

Rather than approximating the desired bar width by printing at a default print resolution, as described above, the print resolution may be varied to achieve the desired bar width. The print resolution needed to achieve the desired bar width is derived from Equation no. 1, according to Equation no. 2 as follows:

$$\text{Print Resolution}=(\text{Bar Width}-\text{Dot Size})+(\text{Number of Dots}-1) \quad \text{Eq. 2}$$

Figure 8:
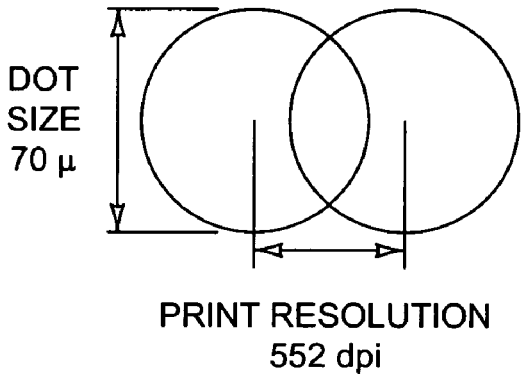
FIG. 8 is a detail view of adjacent ink dots from the bar shown in FIG. 7.

Using the same example described above, the Print Resolution needed to more accurately print a 254 micron bar using five 70 micron diameter dots, as shown in FIGS. 7 and 8, is computed according to Equation no. 2 as follows:

$$\text{Print Resolution}=(254\text{ microns}-70\text{ microns})+(5-1\text{ dots})=552\text{ dpi}$$

Figure 10:
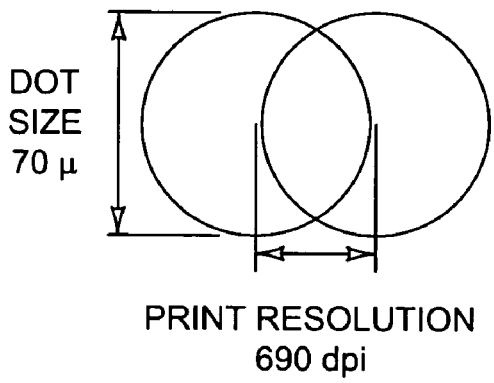
FIG. 10 is a detail view of adjacent ink dots from the bar shown in FIG. 9.

The Print Resolution needed to more accurately print a 254 micron bar using six 70 micron diameter dots, as shown in FIGS. 9 and 10, is computed according to Equation no. 2 as follows:

$$\text{Print Resolution}=(254\text{ microns}-70\text{ microns})+(6-1\text{ dots})=690\text{ dpi.}$$

For a printer that uses a stationary printhead, the print resolution needed to achieve the desired bar width may be obtained by adjusting the frequency at which ink drops are ejected on to the print media or by adjusting the speed at which the media is advanced past the printhead, or both. For example, a Print Resolution of 552 dpi such as that shown in FIGS. 7 and 8 may be achieved by ejecting drops at 11.04 kHertz and advancing the print media past the printhead at a speed of 20 inches per second, or by ejecting drops at 12 kHertz and advancing the print media past the printhead at an adjusted speed of 21.74 inches per second. For a printer that uses a scanning printhead, the print resolution needed to achieve the desired bar width may be obtained by adjusting the frequency at which ink drops are ejected on to the print media or by adjusting the speed at which the printhead is scanned across the print media, or both.

Figure 11:
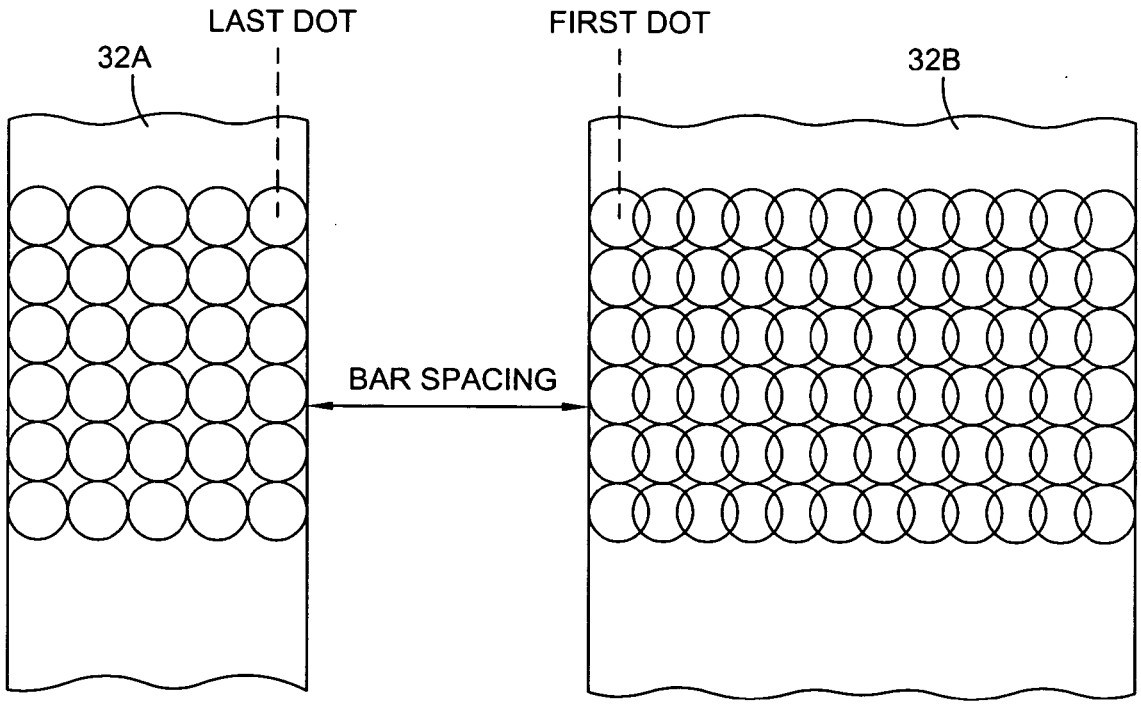
FIG. 11 illustrates two adjacent bars from the bar code shown in FIG. 2.

Additional accuracy may be achieved across the bar code by adjusting the timing of the firing pulse for the first dot in a succeeding bar to correctly position that dot based on the position of the last dot in the preceding bar. For example, and referring to FIG. 11, once the Print Resolution for printing a preceding bar 32A is determined as described above, the position of the center of the last dot in bar 32A may be computed based on the position of the center of the first dot in bar 32A as follows:

$$\text{Last Dot Position}=\text{First Dot Position}+(\text{Number of Dots}-1)\times(\text{Print Resolution}).$$

The position of the center of the first dot in the succeeding bar 32B may then be computed based on the position of the center of the last dot in the preceding bar 32A as follows:

$$\text{First Dot Position}=\text{Last Dot Position}+\text{Bar Spacing}+\text{Dot Size}$$

where Bar Spacing is the distance between the preceding and succeeding bars 32A and 32B. The timing of the firing pulse that ejects the drop for the first dot in the succeeding bar is adjusted to position the first dot at the desired location. The processes described above may be repeated for each bar in the bar code to help achieve greater dimensional accuracy across the full width of the bar code.

Figure 12:
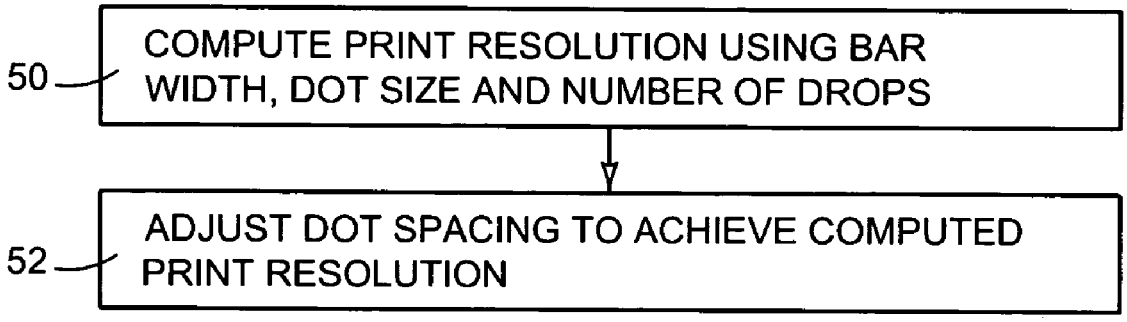
FIGS. 12-14 are flow diagrams illustrating method embodiments.
Figure 13:
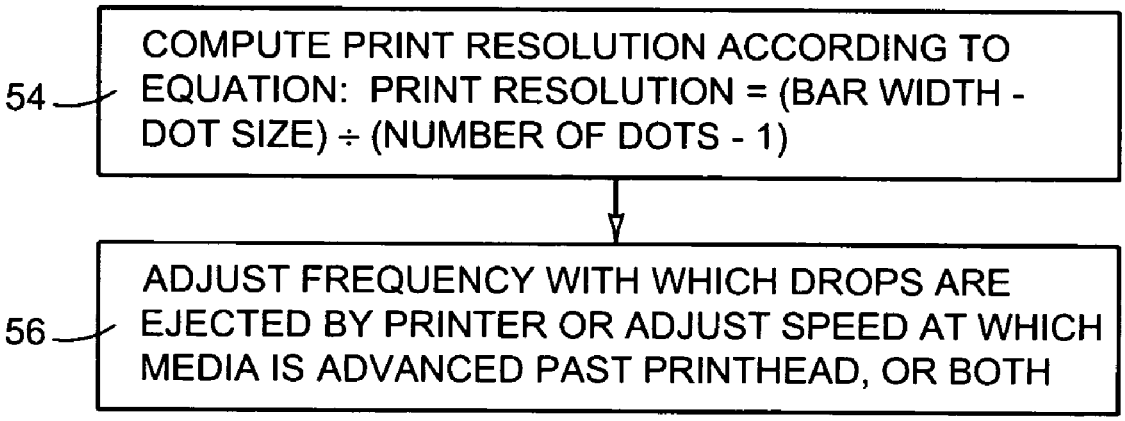

The flow chart of FIG. 12 illustrates one method for printing a bar in a bar code. Referring to FIG. 12, a Print Resolution is computed for printing the bar using Bar Width, Dot Size and Number of Dots (step 50) and then the spacing between ink dots on the print media is adjusted to achieve the computed print resolution (step 52). The flow chart of FIG. 13 illustrates another method in which the Print Resolution is computed according to the equation $$\text{Print Resolution}=(\text{Bar Width}-\text{Dot Size})+(\text{Number of Dots}-1)$$

where Bar Width is a desired width of the bar, Dot Size is a nominal diameter on the print media of each dot and Number of Dots is the number of dots to be printed across the width of the bar (step 54) and the spacing between ink dots is adjusted by adjusting the frequency with which ink drops are ejected by the inkjet printer or adjusting the speed at which print media is advanced past the printhead, or both, to achieve the computed Print Resolution (step 56).

Figure 14:
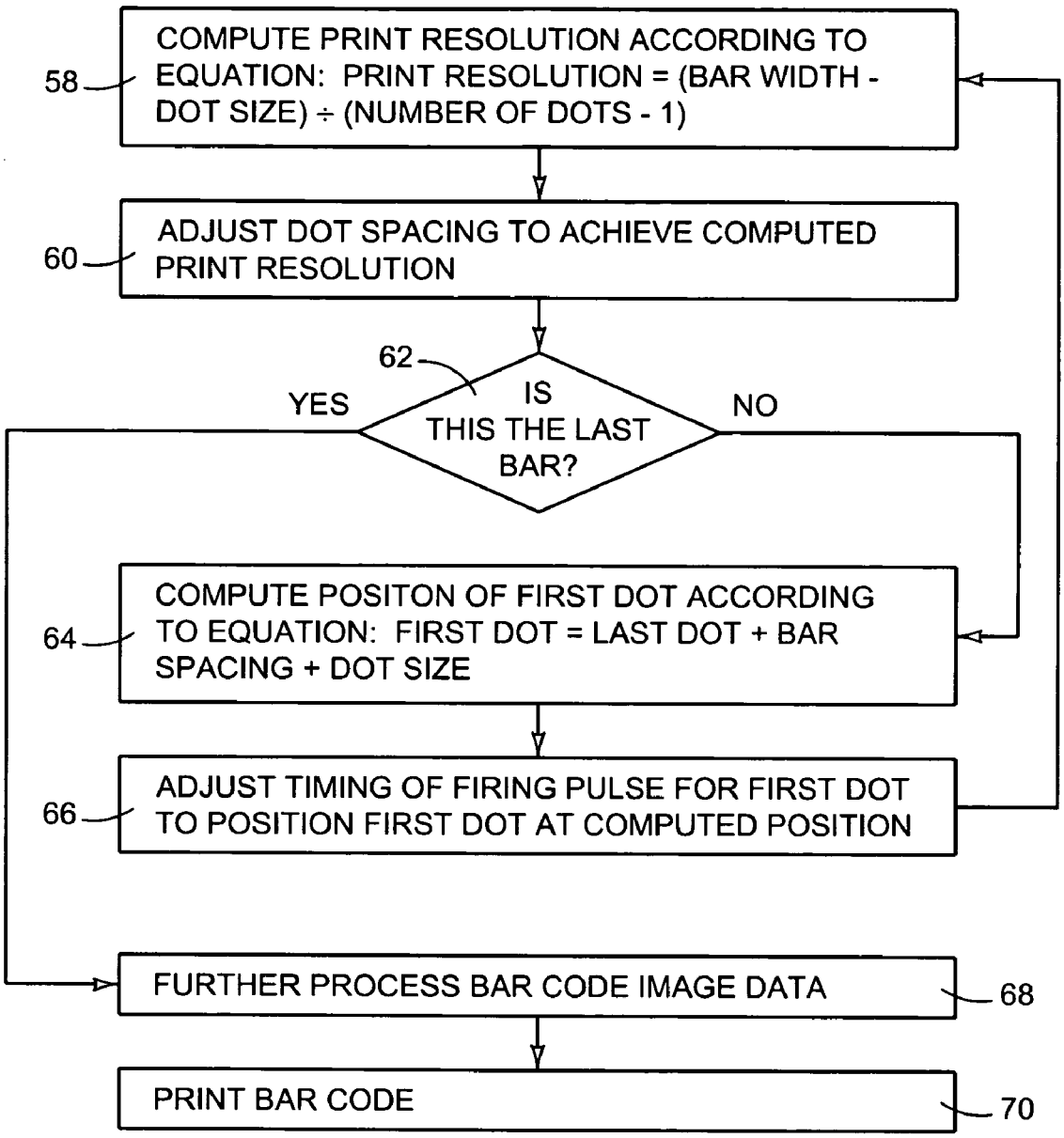

The flow chart of FIG. 14 illustrates one method for printing a bar code. Referring to FIG. 14, a Print Resolution is computed for printing a bar in the bar code according to the equation $$\text{Print Resolution}=(\text{Bar Width}-\text{Dot Size})+(\text{Number of Dots}-1)$$

where Bar Width is a desired width of the bar, Dot Size is the nominal diameter on the print media of each dot and Number of Dots is the number of dots to be printed across the width of the bar (step 58) and then the spacing between ink dots on the print media is adjusted to achieve the computed Print Resolution (step 60). If this is not the last bar in the bar code (step 62), then the position of the first dot in the next bar is computed according to the equation First Dot Position=Last Dot Position+Bar Spacing+Dot Size where Last Dot Position is the position of the center of the last dot in the preceding bar, Bar Spacing is the distance between the two bars and Dot Size is the nominal diameter on the print media of each dot (step 64), the timing of the firing pulse that ejects the drop for the First Dot Position in the bar is adjusted to position the first dot at the desired location (step 66) and then the method returns to step 58. When the last bar is reached (step 62), the image data for the bar code, including the data generated in steps 58, 60, 64 and 66, is subjected to any further processing necessary to prepare the bar code for printing (step 68) and the bar code is printed (step 70).

Figure 15:
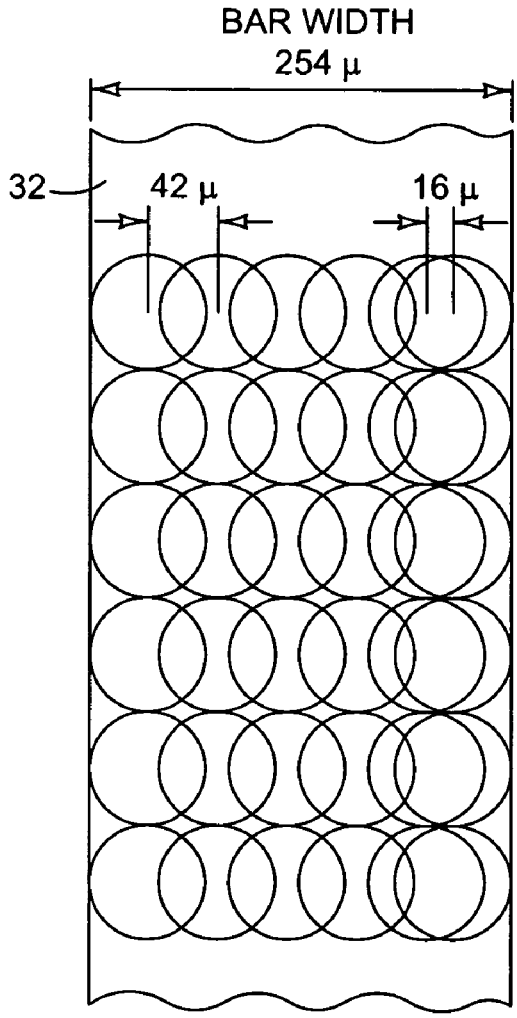
FIG. 15 illustrates a single bar from a bar code in which printing the last dot is advanced to achieve the desired bar width.
Figure 16:
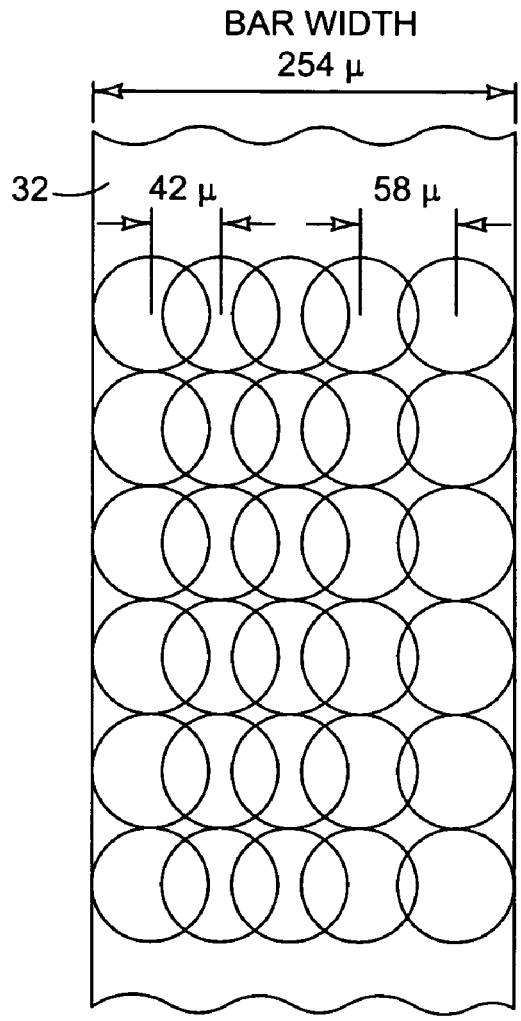
FIG. 16 illustrates a single bar from a bar code in which printing the last dot is delayed to achieve the desired bar width.

In another embodiment, the desired bar width is achieved by adjusting the spacing between only the first two dots in the bar, or the last two dots in the bar, or both, rather than adjusting the print resolution across the full width of bar 32. Where printing a bar 32 at a default print resolution will result in a bar 32 that is wider than desired, such as the 280 micron wide bar 32 shown in FIG. 5, then firing the first dot in the bar may be delayed, firing the last dot in the bar may be advanced, or firing the first dot delayed and firing the last dot advanced to achieve the desired bar width. For example, and referring to FIG. 15, a 254 micron bar 32 may be printed with six 70 micron diameter dots at a 42 micron dot-to-dot spacing (600 dpi) except for the last dot, which is printed only 16 microns from the preceding dot. If the printer is not capable of firing the last dot fast enough to achieve the desired spacing, then one fewer dot may be printed across the width of the bar and firing the last dot is delayed to achieve the desired bar width. For example, and referring to FIG. 16, a 254 micron bar 32 may be printed with five 70 micron diameter dots at a 42 micron dot-to-dot spacing (600 dpi) except for the last dot, which is printed 58 microns from the preceding dot.

Figure 17:
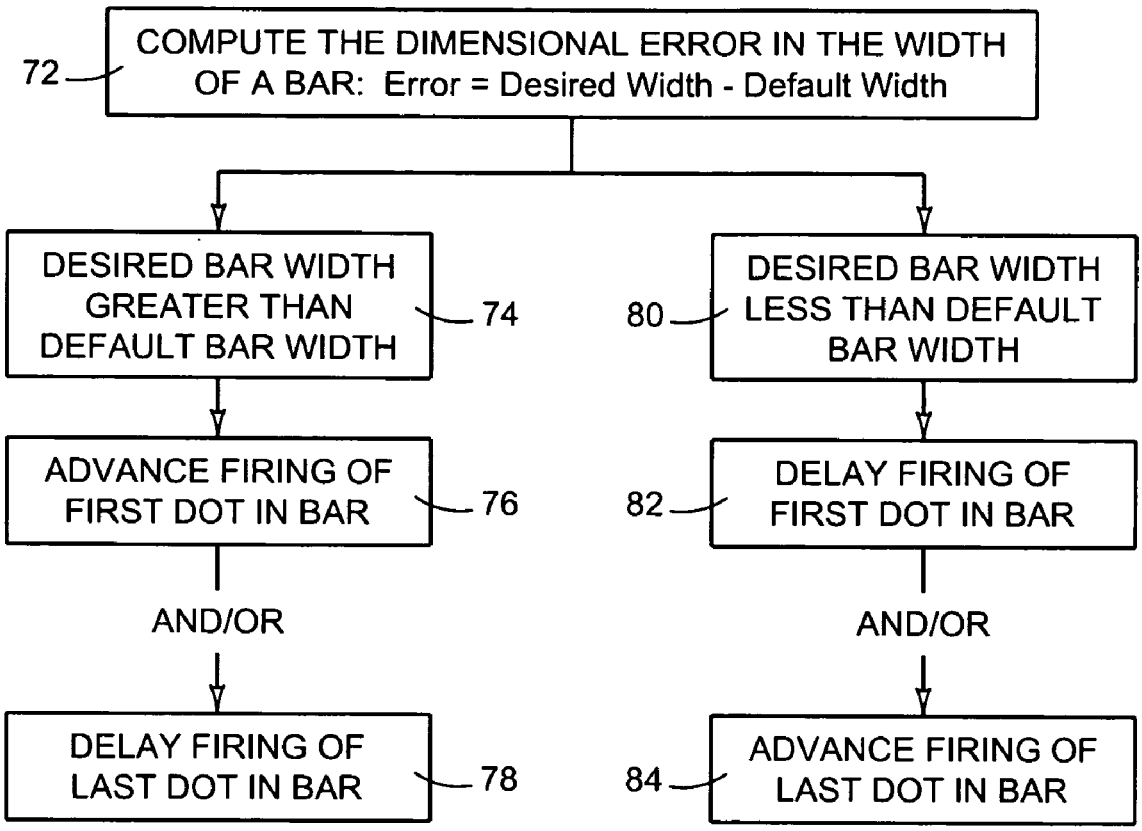
FIG. 17 is a flow diagram illustrating another method embodiment.

The flow chart of FIG. 17 illustrates one method for printing a bar in a bar code. Referring to FIG. 17, the dimensional error in the width of the bar if it is printed at a default print resolution (the default width) is computed at step 72 as the difference between the desired width of the bar and the default width, according to Equation no. 3 as follows:

Error=Desired Width−Default Width Eq. 3 where the Default Width is computed according to Equation no. 1 above (Bar Width=Dot Size+((Number of Dots−1)× Print Resolution). If the Desired Width is greater than the Default Width (step 74), then firing the first dot in the bar is advanced (step 76) or firing the last dot in the bar is delayed (step 78) in an amount equal to the computed Error. If advancing the first dot or delaying the last dot would cause excessive white space between two dots, then firing the first dot may be advanced and firing the last dot delayed in a combined amount equal to the computed Error.

If the Desired Width is less than the Default Width (step 80), then firing the first dot in the bar is delayed (step 82) or firing the last dot in the bar is advanced (step 84) in an amount equal to the computed Error. If delaying the first dot or advancing the last dot would exceed the printer's maximum firing frequency, then firing the first dot may be delayed and firing the last dot advanced in a combined amount equal to the computed Error.

While it is expected that the programming used to implement the methods illustrated in FIGS. 12-14 and 17 will usually reside on printer controller 20 (FIG. 1), such programming could also reside on a host device 28 (FIG. 1) as part of a printer driver or a bar code printing application program. In one implementation, the programming for a conventional bar code raster image processor (RIP) is modified to compute print resolution and adjust dot spacing in accordance with the methods described above. This programming and the processor executing the programming usually reside on the printer controller, such as printer controller 20 in FIG. 1. Programming implementing the methods illustrated in FIGS. 12-14 may be embodied in any processor readable medium. "Processor readable medium" as used in this document includes any medium that has the capacity to provide signals, instructions and/or data. A processor readable medium may take many forms, including, for example, non-volatile media, volatile media, and transmission media or signals. Common forms of processor-readable media include, but are not limited to, an application specific integrated circuit (ASIC), a compact disc (CD), a digital video disk (DVD), a random access memory (RAM), a read only memory (ROM), a programmable read only memory (PROM), an electronically erasable programmable read only memory (EEPROM), a disk, a carrier wave, a memory stick, a floppy disk, a flexible disk, a hard disk, a magnetic tape, a CD-ROM, an EPROM, and a FLASH-EPROM. Any signal that can propagate instructions or data may be considered a "processor-readable medium."

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A method for printing bars in a bar code with an inkjet printer, comprising:

computing a print resolution for printing a first bar according to the equation

First Print Resolution=(First Bar Width−Dot Size)+(First Number of Dots−1)

where First Bar Width is a desired width of the first bar, Dot Size is the nominal diameter of each ink dot and First Number of Dots is the number of ink dots to be printed across the width of the first bar;

adjusting a spacing between ink dots across the width of the first bar based on the computed first print resolution;

computing a position of a first ink dot in a second bar according to the equation First Dot Position=Last Dot Position+Bar Spacing+Dot Size where Last Dot Position is the position of the center of the last ink dot in the first bar and Bar Spacing is the distance between the first and second bars;

adjusting a timing of a firing pulse for ejecting an ink drop for the first ink dot to position the first ink dot at the computed position;

computing a second print resolution for printing the second bar according to the equation Second Print Resolution=(Second Bar Width−Dot Size)+(Second Number of Dots−1)

where Second Bar Width is a desired width of the second bar, Dot Size is the nominal diameter of each ink dot and Second Number of Dots is the number of ink dots to be printed across the width of the second bar;

adjusting a spacing between ink dots across the width of the second bar based on the computed second print resolution;

printing the first bar; and printing the second bar.

2. A processor readable medium having instructions for:

computing a first print resolution for printing a first bar according to the equation First Print Resolution=(First Bar Width−Dot Size)+(First Number of Dots−1)

where First Bar Width is a desired width of the first bar, Dot Size is the nominal diameter of each ink dot and First Number of Dots is the number of ink dots to be printed across the width of the first bar;

adjusting a spacing between ink dots on the print media printed across the width of the first bar based on the computed first print resolution;

computing a position of a first ink dot in a second bar according to the equation First Dot Position=Last Dot Position+Bar Spacing+Dot Size where Last Dot Postion is the position of the center of the last ink dot in the first bar and Bar Spacing is the distance between the first and second bars;

adjusting a timing of a firing pulse for ejecting an ink drop for the first ink dot to position the first ink dot at the computed position;

computing a second print resolution for printing the second bar according to the equation Second Print Resolution=(Second Bar Width−Dot Size)+(Second Number of Dots−1)

where Second Bar Width is the desired width of the second bar, Dot Size is the nominal diameter of each ink dot and Second Number of Dots is the number of ink dots to be printed across the width of the second bar; and adjusting a spacing between ink dots across the width of the second bar based on the computed second print resolution.

3. A bar code, comprising:

a first bar comprising first dots having a first center to center spacing computed according to the equation First Spacing=(First Bar Width−First Dot Size)+(First Number of Dots−1)

where First Bar Width is a desired width of the first bar, First Dot Size is the nominal dimension of each of the first dots measured in a direction across the width of the first bar and First Number of Dots is the number of dots across the width of the first bar;

a second bar comprising second dots having a second center to center spacing computed according to the equation Second Spacing=(Second Bar Width−Second Dot Size)+(Second Number of Dots−1)

where Second Bar Width is a desired width of the second bar, Second Dot Size is the nominal dimension of each of the second dots measured in a direction across the width of the second bar and Second Number of Dots is the number of dots across the width of the second bar; and the second bar including a first dot positioned according to the equation First Dot Position=Last Dot Position+Bar Spacing+Second Dot Size where Last Dot Position is the position of the center of the last dot in the first bar, Bar Spacing is the distance between the first and second bars, and Second Dot Size is the nominal dimension of each of the second dots measured in a direction across the width of the second bar.

* * * * *

UNITED STATES PATENT AND TRADEMARK OFFICE

CERTIFICATE OF CORRECTION

PATENT NO. : 7,461,917 B2
APPLICATION NO. : 11/007931
DATED : December 9, 2008
INVENTOR(S) : Robert Fogarty et al.

It is certified that error appears in the above-identified patent and that said Letters Patent is hereby corrected as shown below:

In column 3, lines 45-46, delete "Print Resolution=(Bar Width-Dot Size)+ (Number of Dots-1)" and insert -- Print Resolution=(Bar Width-Dot Size)÷ (Number of Dots-1) --, therefor.

In column 3, lines 52-53, delete "Print Resolution=(254 microns-70 microns)+ (5-1 dots)=552 dpi" and insert -- Print Resolution=(254 microns-70 microns)÷ (5-1 dots)=552 dpi --, therefor.

In column 3, lines 60-61, delete "Print Resolution=(254 microns-70 microns)+ (6-1 dots)=690 dpi." and insert -- Print Resolution=(254 microns-70 microns)÷ (6-1 dots)=690 dpi. --, therefor.

In column 4, lines 45-46, delete "Print Resolution=(Bar Width-Dot Size)+ (Number of Dots-1)" and insert -- Print Resolution=(Bar Width-Dot Size)÷ (Number of Dots-1) --, therefor.

In column 4, lines 60-61, delete "Print Resolution=(Bar Width-Dot Size)+ (Number of Dots-1)" and insert -- Print Resolution=(Bar Width-Dot Size)÷ (Number of Dots-1) --, therefor.

In column 6, line 38, in Claim 1, before "print" insert -- first --.

In column 6, lines 40-41, in Claim 1, delete "First Print Resolution=(First Bar Width-Dot Size)+(First Number of Dots-1)" and insert -- First Print Resolution=(First Bar Width-Dot Size)÷(First Number of Dots-1) --, therefor.

In column 6, lines 62-63, in Claim 1, delete "Second Print Resolution=(Second Bar Width-Dot Size)+(Second Number of Dots-1)" and insert -- Second Print Resolution=(Second Bar Width-Dot Size)÷(Second Number of Dots-1) --, therefor.

In column 7, lines 9-10, in Claim 2, delete "First Print Resolution=(First Bar Width-Dot Size)+(First Number of Dots-1)" and insert -- First Print Resolution=(First Bar Width-Dot Size)÷(First Number of Dots-1) --, therefor.

In column 7, line 23, in Claim 2, delete "Postion" and insert -- Position --, therefor.

In column 7, lines 31-32, in Claim 2, delete "Second Print Resolution=(Second Bar Width-Dot Size)+(Second Number of Dots-1)" and insert -- Second Print Resolution=(Second Bar Width-Dot Size)÷(Second Number of Dots-1) --, therefor.

UNITED STATES PATENT AND TRADEMARK OFFICE

CERTIFICATE OF CORRECTION

PATENT NO. : 7,461,917 B2
APPLICATION NO. : 11/007931
DATED : December 9, 2008
INVENTOR(S) : Robert Fogarty et al.

It is certified that error appears in the above-identified patent and that said Letters Patent is hereby corrected as shown below:

In column 8, lines 7-8, in Claim 3, delete "First Spacing=(First Bar Width-First Dot Size)+(First Number of Dots-1)" and insert -- First Spacing=(First Bar Width-First Dot Size)÷(First Number of Dots-1) --, therefor.

In column 8, lines 17-18, in Claim 3, delete "Second Spacing=(Second Bar Width-Second Dot Size)+(Second Number of Dots-1)" and insert -- Second Spacing=(Second Bar Width-Second Dot Size)÷(Second Number of Dots-1) --, therefor.

Signed and Sealed this

Seventh Day of April, 2009

John Doll

JOHN DOLL
*Acting Director of the United States Patent and Trademark Office*